US005285848A

United States Patent [19]

Chang

[11] Patent Number: 5,285,848

[45] Date of Patent: Feb. 15, 1994

[54] METHOD FOR IMPROVING THE RECOVERY OF OIL FROM A SUBTERRANEAN FORMATION BY SOLVENT CONCENTRATION GRADING

[75] Inventor: Harry L. Chang, Dallas, Tex.

[73] Assignee: Atlantic Richfield Company, Los Angeles, Calif.

[21] Appl. No.: 976,748

[22] Filed: Nov. 16, 1992

[51] Int. Cl.[5] ..... E21B 43/00

[52] U.S. Cl. ..... 166/279; 166/274

[58] Field of Search ..... 166/279, 305.1, 306, 166/311, 312, 268, 269, 272-275, 266

[56] References Cited

U.S. PATENT DOCUMENTS 4,109,720 8/1978 Allen et al. ..... 166/274 X
4,418,753 12/1983 Morel et al. ..... 166/273
4,678,036 7/1987 Hartman et al. ..... 166/274 X

*Primary Examiner*—Thuy M. Bui
*Attorney, Agent, or Firm*—F. Lindsey Scott

[57] ABSTRACT

A method for increasing oil recovery from a subterranean formation, the method consisting essentially of injecting a slug of water equal in volume to at least about 20% of the hydrocarbon pore volume of the formation into the formation, thereafter injecting a slug of solvent, the solvent consisting of materials selected from the group consisting of carbon dioxide, nitrogen, methane, hydrocarbons containing from 2 to about 5 carbon atoms and mixtures thereof, into the formation in a volume equal to from about 2% to about 10% of the initial hydrocarbon pore volume of the formation, thereafter injecting a water slug in an volume equal to from about 0.5 to about 3.0 times the volume of the preceding solvent slug, and repeating the solvent and water injection steps for a plurality of cycles with the amount of hydrocarbons containing from 2 to about 5 carbon atoms in the solvent decreasing from about 90 to about 100 mole percent in the initial solvent to about 30 mole percent in the final solvent and with the volume of solvent in each slug after the first being from about 0.5% to about 2.0% of the initial hydrocarbon pore volume of the formation, and injecting after the last solvent slug, a slug of water equal in volume to at least about 20% of the initial hydrocarbon pore volume of the formation.

11 Claims, 1 Drawing Sheet

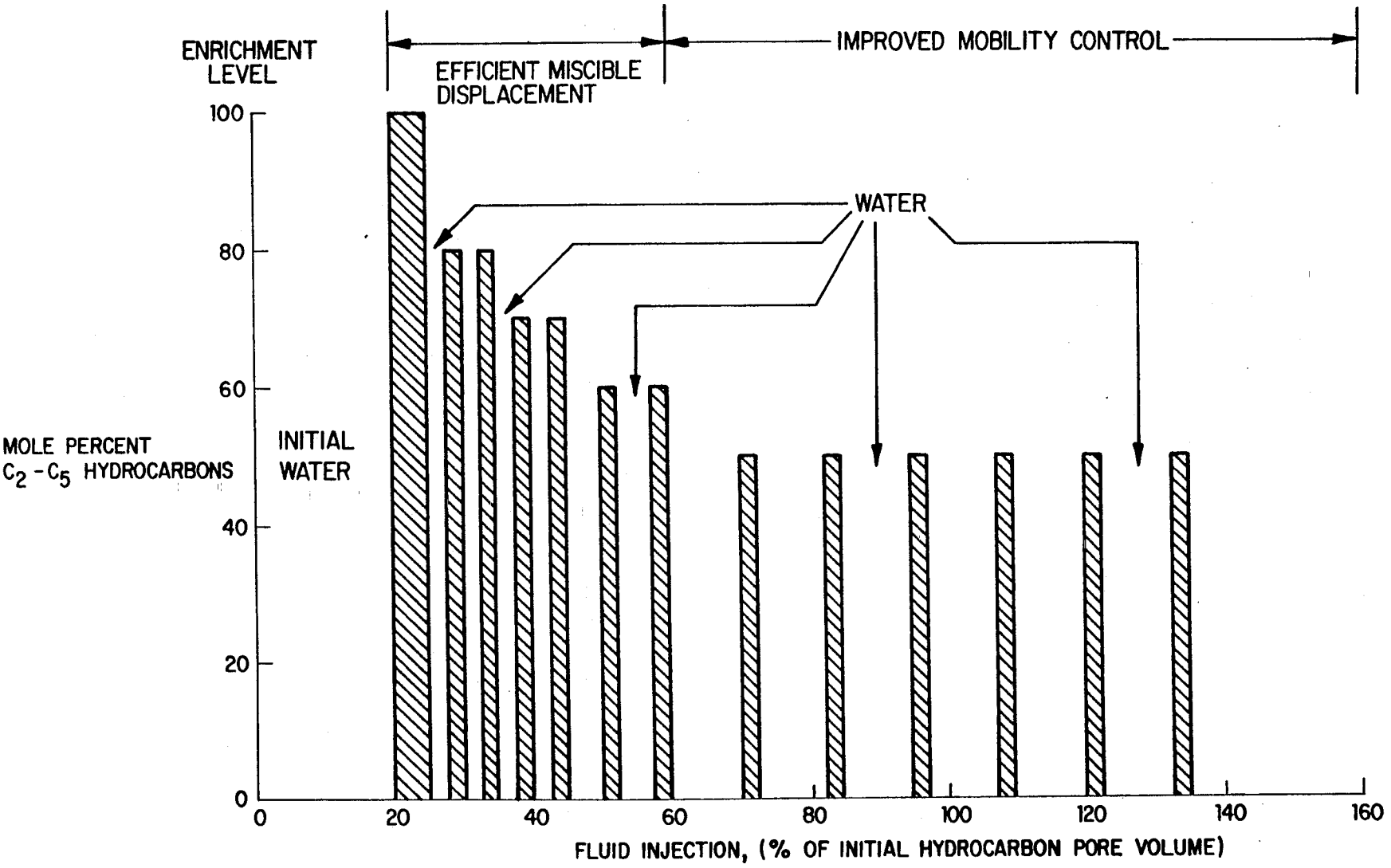
IMPROVED MOBILITY CONTROL
EFFICIENT MISCIBLE DISPLACEMENT
WATER
ENRICHMENT LEVEL
100
80
60
40
20
0
INITIAL WATER
MOLE PERCENT $C_2$ - $C_5$ HYDROCARBONS
0
20
40
60
80
100
120
140
160
FLUID INJECTION, (% OF INITIAL HYDROCARBON PORE VOLUME)

METHOD FOR IMPROVING THE RECOVERY OF OIL FROM A SUBTERRANEAN FORMATION BY SOLVENT CONCENTRATION GRADING

BACKGROUND OF THE INVENTION

1. Field of the Invention

This invention relates to an alternating water/solvent/gas injection method for increasing the recovery of oil from a subterranean formation.

2. Background

Water alternating gas (WAG) processes have been used heretofore to recover hydrocarbons from subterranean formations. In such processes, water is first injected into the formation followed by a quantity of gas which is, in turn, followed with an additional slug of water with the steps being repeated a number of times. The sizes of the gas slugs typically used vary from 20% to 40% of the initial hydrocarbon pore volume of the formation. Gas compositions are usually maintained at a constant level and may be followed by either water or, in some instances, another gas. Such processes are generally used to improve the mobility control of the injected fluids in the formation. In other words, the water has a lower injected fluid/oil-mobility ratio than does the gas. Desirably, the ratio of rate of injected fluid flow through the formation to the rate of oil flow through the formation is less than 1. Values greater than 1 are undesirable since, in such instances, the injected material moves through the formation faster than the oil and tends to bypass oil in the formation, thereby channelling through the formation and bypassing many of the areas which it is desired to contact. Gas typically has an even higher mobility ratio which may be as high as 10 to 100. Obviously, gas will quickly channel through a formation bypassing many of the areas it is desired to contact.

Further, the use of pure component gases, such as carbon dioxide, tends to result in a multi-contact miscible environment in the formation. The term "multi-contact miscible environment" refers to an environment in which it takes multiple contacts for the gas and oil to mix, thereby eliminating the interfaces between the gas and oil to the point where the oil can be more easily recovered from the formation. This process generally takes multiple gas contacts with the oil and the like.

In a variation of this process, rich gas mixtures which consist of hydrocarbon gases containing from two carbon atoms to about five carbon atoms, are used. These rich gas mixtures are frequently liquid in the formation environment and function more as a solvent. The result is an environment referred to as a "first contact miscible environment". In such an environment, the solvent and oil mix on first contact and then the oil is more readily flowed from the formation. Such processes result in much better efficiency but they require the use of more expensive materials and as a result are used less frequently.

Multi-contact miscible environments using lean gases, i.e. pure component gases such as methane, nitrogen, carbon dioxide or mixtures thereof, which require multiple contacts or longer contact periods are used more frequently.

Since the recovery of additional oil from a subterranean formation is, in most instances, an expensive process, a continuing search has been directed to the development of more effective and efficient ways to recover additional oil from subterranean formations economically.

SUMMARY OF THE INVENTION

According to the present invention, the recovery of oil from a subterranean formation is increased by a method consisting essentially of injecting a slug of water equal in volume to at least about 20% of the initial hydrocarbon pore volume of the formation into the formation, thereafter injecting a slug of solvent, the solvent comprising a rich gas consisting of materials selected from the group consisting of hydrocarbons containing from 2 to about 5 carbon atoms and mixtures thereof, into the formation in a volume equal to from about 2% to about 10% of the initial hydrocarbon pore volume of the formation, thereafter injecting a water slug in an volume equal to from about 0.5 to about 3.0 times the volume of the preceding solvent slug, and repeating the solvent and water injection steps for a plurality of cycles with the amount of rich gas in the solvent decreasing from about 90 to about 100 mole percent in the initial solvent to about 30 mole percent in the final solvent and with the volume of solvent in each slug after the first being from about 0.5% to about 2.0% of the initial hydrocarbon pore volume of the formation, and injecting after the last solvent slug, a slug of water equal in volume to at least about 20% of the initial hydrocarbon pore volume of the formation.

BRIEF DESCRIPTION OF THE DRAWING

The Figure shows an injection profile for an embodiment of the present invention.

DESCRIPTION OF PREFERRED EMBODIMENTS

According to the present invention, a slug of water is first injected into the formation to provide good mobility control. It should be understood that, while pure water could be used, it is much more common to use formation brine or the like. Generally, when water is referred in this context it refers to brine of a composition compatible with, and in many instances the same as, the brine naturally occurring in the subterranean formation. The water is generally injected in a volume equal to at least about 20% of the initial hydrocarbon pore volume of the formation. The term "initial hydrocarbon pore volume of the formation" (IHCPV) as used herein refers to the initial hydrocarbon pore volume of the formation in the area which will be treated by the particular injection process. The initial hydrocarbon pore volume is generally considered to be equal to the total initial pore volume minus the initial water wet pore volume of the formation.

After injection of the slug of water into the formation, a slug of solvent equal to from about 2 to about 10 percent of the IHCPV is injected. The solvent consists of from about 90 to about 100 mole percent of a rich gas mixture consisting of materials selected from the group consisting of light hydrocarbons containing from 2 to about 5 carbon atoms and mixtures thereof with the balance usually being methane, nitrogen, carbon dioxide or mixtures thereof.

After injection of the initial solvent slug into the formation, a second water slug is injected into the formation in a volume equal to from about 0.5 to about 3.0 times the volume of the preceding solvent slug.

Thereafter, the sequence of operations is repeated for a plurality of cycles with the amount of rich gas contained in the solvent decreasing from about 90 to about 100 mole percent in the initial solvent slug to about 30 mole percent in the final solvent slug. The volume of solvent in each slug after the first solvent slug is desirably from about 0.5 to about 2.0 percent of the IHCPV.

After the last solvent slug has been injected, a slug of water equal in volume to at least about 20% of the IHCPV is injected. This last water slug injection is typically followed by a continuous water injection for a period of time to recover additional oil from the formation.

In certain tests using light hydrocarbon gases in first contact miscible environment tests with selected crude oils, it has been found that an equal molar mixture of ethane, propane and butane is extremely effective in such recoveries. This effectiveness continues even when the mixture is diluted with methane, nitrogen or carbon dioxide up to about 70 mole percent dilution. Accordingly, it appears that desirable recovery can still be accomplished even when the concentration of rich gas contained in the injected solvent is reduced. According to the present invention, the first slug of injected solvent functions to create a first contact miscible behavior zone in the formation which is effective to create a better sweep pattern in the formation as a result of the desired mixing of the solvent and oil on first contact. Mobility control of the solvent slug is accomplished by the leading water slug and by the trailing water slug. The first solvent slug is desirably somewhat larger than the succeeding solvent slugs and typically is from about 2 to about 10 percent of the IHCPV, although the initial slug may be equal to from about 3 to about 7 percent of the IHCPV and is desirably from about 4 to about 6 percent of the IHCPV. Typically, in such processes, the total amount of water and solvent injected into the formation during the water/gas/solvent injection process is equal to from about 1.5 to about 2.5 times the IHCPV. Typically, the amount of solvent injected is equal to from about 20 to about 40 percent of the IHCPV. According to the present invention, the amount of rich gas contained in the solvent may be decreased after each 20% increment of the total solvent has been injected down to a minimum of about 30 mole percent rich gas in the injected solvent. The decreased quantities of rich gas in the injected solvent results in a multi-contact miscible environment in the formation and is less effective in oil contact than the single point contact environment created during the initial solvent injection. Nevertheless, the continued treatment of the formation remains effective since the use of larger quantities of lean gases results in increased penetration of parts of the formation and in further contact with oil which may not have been solubilized or mobilized initially. The mobility of the solvent slugs in each instance is controlled by the preceding and the trailing water slug.

Mobility control is more important as more solvent is injected into the formation due to the increased volume of pore space available for solvent flow. Desirably, the volume of the water slugs is from about 0.5 to about 1.5 times the volume of the preceeding solvent slug when less than 40 percent of the total volume of solvent has been injected. The volume of the water slugs is desirably increased to from about 1.5 to about 2.5 times the volume of the preceeding solvent slug when from about 40 to about 60 percent of the total volume of solvent has been injected and the volume of the water slug is desirably increased to from about 2.5 to about 3.0 times the volume of the preceeding solvent slug after about 60 percent of the total volume of solvent has been injected.

In the Figure, an injection profile of the present invention is shown. An initial slug of solvent comprising 100% rich gas is injected. The initial slug and the following slugs (shown as dark bars) which contain above about 60% rich gas are shown as an "efficient, miscible displacement" portion of the recovery process for the particular environment depicted. This will, of course, vary as different crude oils and different formations are considered. The extension of the efficient miscible displacement zone to about 60% enrichment of the solvent with rich gases is the result of the finding that, in the particular system depicted, the solvents could be diluted with lean gases to this extent while continuing to maintain effective miscible behavior with the oil. After the injection of portions of the solvent, improved mobility control is necessary and is depicted by the increasing amounts of the water slugs injected (shown as spaces between the dark bars) while a miscible behavior environment is maintained in the formation to continue to recover additional hydrocarbons from the formation. The use of the reduced quantities of rich gas in the solvent after the initial solvent slugs is made possible by the use of added quantities of lean gases such as methane, nitrogen or carbon dioxide so that continued multi-contact miscible environments are maintained in portions of the formation contacted by the process during the improved mobility control phase.

In the Figure, the solvent slugs are diluted with a lean gas to achieve the enrichment levels shown.

By use of the present process, the benefits of a first contact miscible treatment combined with the desirable attributes, especially the reduced cost, of a multi-contact miscible treatment are accomplished in a single process. In the practice of the present invention a variety of injection patterns can be used. For instance, line drive systems, five spot injection patterns and the like may be used. For all such injection patterns, the area of the formation treated can be readily calculated or estimated by those skilled in the art.

Having thus described the invention by reference to its preferred embodiments, it is pointed out that the embodiments discussed are illustrative rather than limiting in nature and that many variations and modifications are possible within the scope of the present invention. Many such variations and modifications may be considered obvious or desirable by those skilled in the art based upon a review of the foregoing description of preferred embodiments.

Having thus described the invention, I claim:

1. A method for increasing oil recovery from a subterranean formation, the method consisting essentially of:

a) injecting a slug of water equal in volume to at least about 20% of an initial hydrocarbon pore volume of the formation into the formation;

b) thereafter injecting a slug of solvent, the solvent consisting of materials selected from the group consisting of carbon dioxide, nitrogen, methane, hydrocarbons containing from 2 to about 5 carbon atoms and mixtures thereof, into the formation in a volume equal to from about 2% to about 10% of the initial hydrocarbon pore volume of the formation;

c) thereafter injecting a water slug in an volume equal to from about 0.5 to about 3.0 times the volume of the preceding solvent slug;

d) repeating the solvent and water injection steps for a plurality of cycles with the amount of light hydrocarbons containing from 2 to about 5 carbon atoms in the solvent decreasing from about 90 to about 100 mole percent in the initial solvent to about 30 mole percent in the final solvent and with the volume of solvent in each slug after the first being from about 0.5% to about 2.0% of the initial hydrocarbon pore volume of the formation; and e) injecting after the last solvent slug, a slug of water equal in volume to at least about 20% of the initial hydrocarbon pore volume of the formation.

2. The method of claim 1 wherein said water is brine.

3. The method of claim 1 wherein said solvent is injected into said formation in slugs equal to from about 3 to about 7 percent of the initial hydrocarbon pore volume of the formation.

4. The method of claim 1 wherein said solvent is injected into said formation in slugs equal to from about 4 to about 6 percent of the initial hydrocarbon pore volume of the formation.

5. The method of claim 1 wherein the total volume of solvent and water injected into the formation is equal to from about 1.5 to about 2.5 times the initial hydrocarbon pore volume of the formation.

6. The method of claim 5 wherein the total amount of solvent injected is from about 20 to about 40 percent of the initial hydrocarbon pore volume of the formation.

7. The method of claim 1 wherein continuous water injection is resumed following said slug of water injected after said last solvent injection.

8. The method of claim 1 wherein the amount of light hydrocarbons containing from 2 to about 5 carbon atoms is decreased after each 20 percent increment of said solvent has been injected.

9. The method of claim 1 wherein the volume of said water slug following a preceding said solvent slug is from about 0.5 to about 1.5 times the volume of said solvent slug when less than about 40 percent of the total amount of solvent has been injected.

10. The method of claim 1 wherein the volume of said water slug following a preceding solvent slug is from about 1.5 to about 2.5 times the volume of said solvent slug when from about 40 to about 60 percent of the total amount of solvent has been injected.

11. The method of claim 1 wherein the volume of said water slug following a preceding solvent slug is from about 2.5 to about 3.0 times the volume of said solvent slug when more than about 60 percent of the total volume of solvent has been injected.

* * * * *